US006076480A

United States Patent [19]

Chang, III et al.

[11] Patent Number: 6,076,480

[45] Date of Patent: Jun. 20, 2000

[54] FUEL STORING WATER BALLAST TANK INTERNALLY STRUCTURED FOR REDUCING RETENTION OF WATER AND OVERBOARD DISCHARGE OF FUEL

[75] Inventors: Peter A. Chang, III, Silver Spring, Md.; Brian Hill, Falls Church; Dan Bruchman, Centreville, both of Va.; Ray Schmitt, Rivera Beach, Md.; Carl Schmid, West Chester, Pa.; Scott Jackson, Seattle, Wash.

[73] Assignee: The United States of America as represented by the Secretary of the Navy, Washington, D.C.

[21] Appl. No.: 09/247,951

[22] Filed: Feb. 11, 1999

[51] Int. Cl.[7] ..... B63B 39/03

[52] U.S. Cl. ..... 114/125; 114/74 R; 220/563

[58] Field of Search ..... 114/125, 74 R; 220/563

[56] References Cited

U.S. PATENT DOCUMENTS 2,631,558 3/1953 Harris .
3,307,512 3/1967 Fell .

*Primary Examiner*—Sherman Basinger
*Attorney, Agent, or Firm*—John Forrest; Jacob Shuster

[57] ABSTRACT

A tank within a ship providing for both fuel storage and water ballast, has external walls enclosing compartments formed between internal intersecting walls having flow regulating openings therein that are located and sized to establish separate interfaced flow paths along which segregated flows of fuel and water are concentrated to minimize mixing of fuel and water during refueling operation and reduce retention of water within the tank.

5 Claims, 2 Drawing Sheets

FUEL STORING WATER BALLAST TANK INTERNALLY STRUCTURED FOR REDUCING RETENTION OF WATER AND OVERBOARD DISCHARGE OF FUEL

The present invention relates in general to internal tank structure through which interrelated flows of fuel and water are conducted.

BACKGROUND OF THE INVENTION

Dual purpose tanks for providing both fuel storage and water ballast are presently available for use on marine vessels. Such a tank encloses a plurality of internal compartments formed between spaced internal walls having openings formed therein through which flow of the fuel and ballast water is conducted along interfaced flow paths between two flow ports respectively located adjacent opposite side walls of the tank.

The foregoing type of tank is utilized because it conserves a significant amount of hull volume otherwise assigned to separate tanks for different functions such as storage of fuel, refueling and water ballast on ships. A major disadvantage of such multi-purpose tanks involves mixing of the fuel with water during the refueling operation resulting in overboard discharge of fuel with the water thereby creating an environmental pollution problem. Also a large amount of water is retained so as to further limit fuel capacity. Such large amount of water retention occurs in current tank configurations during refueling when the fuel/water interface reaches a critical level in a predetermined compartment internally of the tank within which there is uneven fuel distribution. It is therefore an important object of the present invention to provide marine vessels with the foregoing type of multi-purpose tank internally structured to reduce fuel and water mixing so as to minimize overboard discharge of fuel in compliance with present and future environmental pollution regulations and increase useable fuel capacity.

SUMMARY OF THE INVENTION

In accordance with the present invention, the intermediate internal wall within a dual purpose type of compensated fuel/water-ballast tank is provided with flow directing openings therein, located and sized in cooperation with flow openings in the other internal compartment-forming forming tank walls to substantially eliminate buoyant flow activity heretofore constituting a major cause of fuel entrainment within the compensating water and to promote segregation between fuel and water respectively flowing along the top and bottom walls of the tank toward flow ports through which inflow of fuel and outflow of water is conducted. Additionally, the foregoing wall openings in the internal wall arrangement minimizes retention of water within the tank.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

Figure 5:
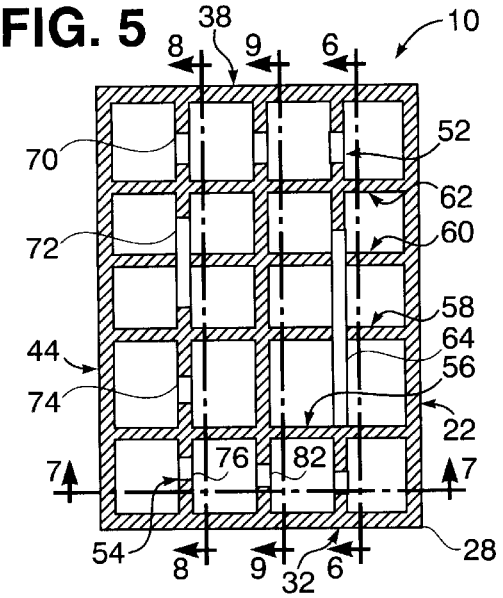
FIG. 5 is a section view taken substantially through a plane indicated by section line 5—5 in FIG. 3.
Figure 8:
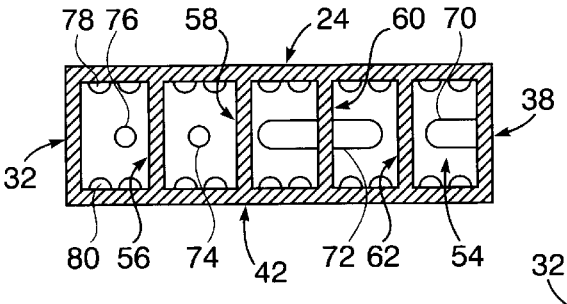
Figure 9:
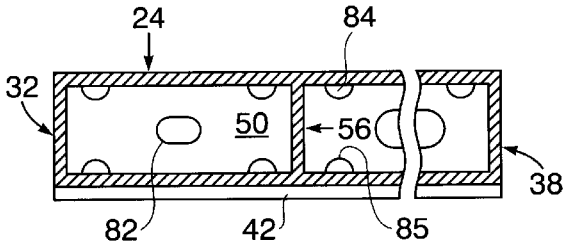
Figure 10:
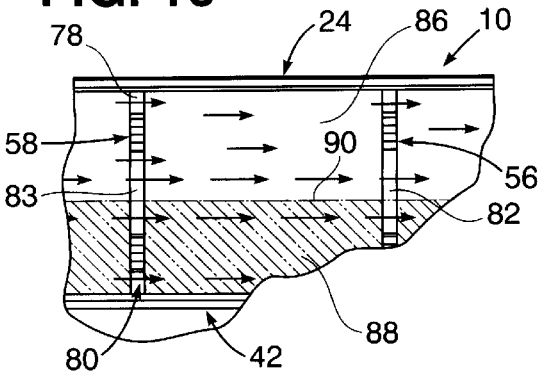
Figure 11:
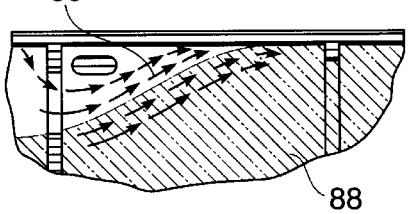

FIGS. 8 and 9 are section views taken substantially through section lines 8—8 and 9—9 respectively in FIG. 5;

FIG. 10 is a partial section view through a portion of the tank shown in FIGS. 2–9, illustrating segregated fuel and water flows therein during refueling; and FIG. 11 is a partial section view corresponding to that of FIG. 10 with respect to prior art tanks, illustrating a buoyant flow event during the refueling operation.

DETAILED DESCRIPTION OF PREFERRED EMBODIMENT

Figure 1:
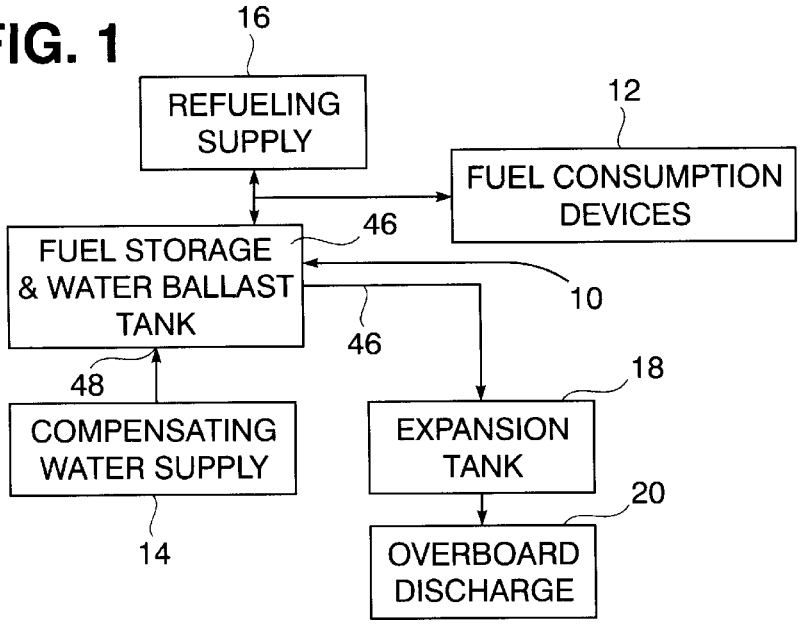
FIG. 1 is a block diagram schematically illustrating the operational environment of a fuel storage and water ballast tank on board a marine vessel.

Referring now to the drawing in detail, FIG. 1 diagrams the operational environment for a compensated fuel/ballast tank 10 utilized on different classes of naval marine vessels to provide both fuel storage and water ballast. With the tank 10 maintained at least partially full of fuel during consumption by devices 12 on the ship, the full tank is also filled with "compensating water" such as seawater from supply 14 as denoted in FIG. 1. Storage of fuel within a full fuel tank during fuel consumption is established by refueling the tank 10 from a supply 16 to force water out of the tank into an expansion tank 18 before discharge overboard 20 as denoted in FIG. 1. In view of the mixing of fuel and water within the tank 10 during such refueling and fuel consumption activity, there will be some fuel discharged with the water. However, pursuant to the present invention tank 10 is internally constructed, as hereinafter described, so as to reduce entrainment of fuel in the compensating water and thereby decrease the amount of overboard outflow of fuel with the water and decrease water retention without controlling flow rates for inflow or outflow of fuel and water relative to the tank 10.

Figure 2:
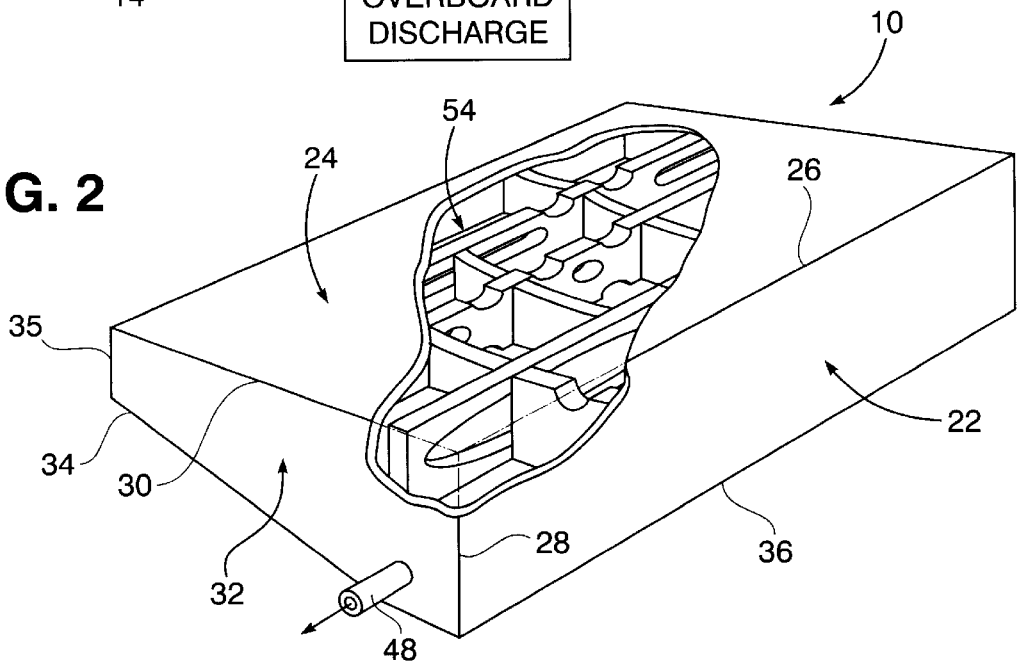
FIG. 2 is a perspective view of the fuel storage and water ballast tank diagramed in FIG. 1 with parts broken away to partially show internal wall structure in accordance with one embodiment of the invention.
Figure 3:
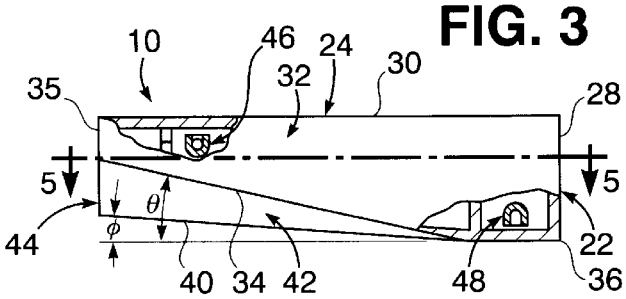
FIG. 3 is a side elevation view of the tank shown in FIG. 2, with parts broken away and shown in section.
Figure 4:
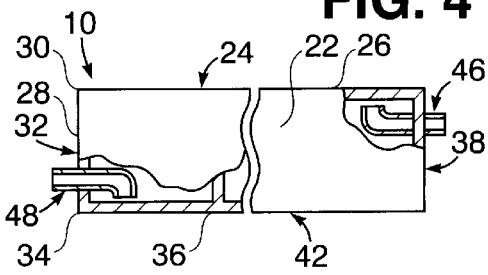
FIG. 4 is a front elevation view of the tank shown in FIG. 2, with parts broken away and shown in section.

Referring now to the structural embodiment illustrated in FIGS. 2, 3 and 4, the tank 10 has a rectangular outer side wall 22 interconnected with a rectangular top wall 24 at right angle thereto along a top perimeter edge 26. The walls 22 and 24 are also connected along top perimeter edges 28 and 30 perpendicular to each other to an outer side wall 32. The wall 32 also has a bottom edge 34 that extends from the edge 28 at a convergent angle $\theta$ toward an edge 35, as designated in FIG. 3 that is shorter than edge 28. The other outer side wall 38 parallel spaced from wall 32 of the tank 10 as shown in FIG. 4, has a bottom edge 40 which extends to outer side wall 44 at a convergent angle $\phi$ smaller than $\theta$ as shown in FIG. 3. The tank 10 is closed by a bottom wall 42, as shown in FIGS. 3 and 4, extending between the bottom wall edges 34 and 40 and between the bottom wall edges 36 and 47.

As also shown in FIGS. 2, 3 and 4, a flow port pipe section 46 for inflow and outflow of fuel extends from an external end into the tank 10 through wall 38 and terminates at an internal end inside of the tank closely spaced below top wall 24. Another flow port pipe section 48 extends into the tank through wall 32 opposite wall 38, adjacent to the edge 28, terminating inside of the tank in spaced adjacency to the bottom wall 42. By conduit connection of such flow port sections 46 and 48 to refueling supply 16, fuel consumption devices 12 and water supply 14 as diagramed in FIG. 1, flow of fuel and water occurs within the tank 10, which is internally compartmented by perpendicular intersecting walls in parallel spaced relation to each other between the outer side walls 22, 44, 32 and 38 as shown in FIG. 5.

With continued reference to FIG. 5, the internal wall structure of the tank 10 includes a longitudinal wall 50 extending between the outer side walls 32 and 38 parallel to and equally spaced from the outer side walls 22 and 44 of the tank 10. Intermediate the outer side wall 22 and internal wall 50 is a parallel spaced longitudinal wall 52, while another parallel spaced longitudinal wall 54 is located between the wall 50 and the outer wall 44. Such internal longitudinal walls 50, 52 and 54 are intersected by four (4) transverse walls 56, 58, 60 and 62 extending between the outer walls 22 and 44 in parallel spaced relation to each other and the other outer walls 32 and 38.

Figure 6:
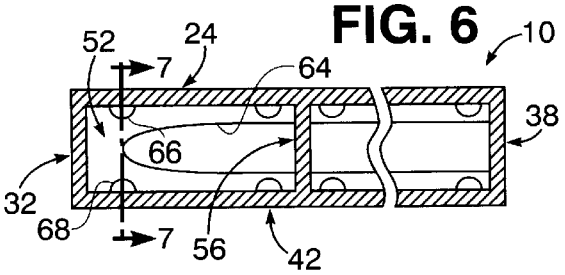
FIG. 6 is a section view taken substantially through a plane indicated by section line 6—6 in FIG. 5.
Figure 7:
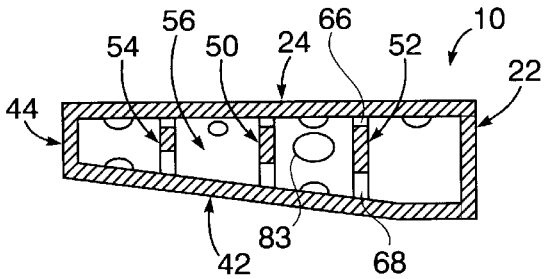
FIG. 7 is a section view taken substantially through a plane indicated by section line 7—7 in FIG. 6.

As shown in FIGS. 5 and 6, the intermediate longitudinal wall 52 on one side of wall 50 is provided with an elongated opening 64 which extends from the wall 38 and converges beyond transverse wall 56 terminating in spaced relation to the wall 32 adjacent to the flow port 48 close to the bottom wall 42 within an internal compartment formed between the intersecting walls 52 and 56 at the corner of the tank forming the edge 28 at the intersection of the walls 22 and 32. In addition to the elongated opening 64 within wall 52 terminating within such corner compartment, pairs of openings 66 and 68 are formed in wall 52 respectively at the outer top wall 24 and the outer bottom wall 42 as shown in FIGS. 6 and 7.

FIGS. 5 and 8 illustrate the other internal longitudinal wall 54 parallel spaced from the wall 50 on one side thereof opposite the wall 52 on the other side. Such internal wall 54 has an elongated slot opening 70 extending from wall 38 and terminating in spaced relation to transverse wall 62. Another elongated slot opening 72 is formed in wall 54, extending between compartments through transverse wall 60. Manholes 74 and 76 are also formed in the wall 54 between pairs of openings 78 and 80 respectively at the outer top and bottom walls 24 and 42 of the tank. Fluid communication is thereby established between internal compartments of the tank by the foregoing described openings in the walls 52 and 54 on opposite sides of the wall 50.

The internal longitudinal wall 50 as shown in FIGS. 5 and 9 is provided with oval-shaped manhole openings 82 while the transverse walls 56 and 58 have manhole opening 83. Reduced flow of fuel is conducted through the manhole openings 83 between compartments formed between the intersecting transverse walls 56, 58, 60 and 62 and the outer walls 32 and 38. Pursuant to the present invention pairs of top backfilling holes 84 are also formed in the wall 50 for each of such compartments at the top wall 24 as well as pairs of holes 85 at the bottom wall through which exiting water is conducted during refueling. The semi-circular shaped holes 84 increase in size and number in the direction toward the inlet fuel jet entering the tank at flow port 46.

As diagramed in FIG. 10, during refueling and water exiting activity within tank 10 a body of fuel 86 located at the top of the tank underlying the top wall 24 undergoes flow through the transverse walls 58, 56, 60 and 62 along the longitudinal walls 50, 52 and 54 in an outflow direction in contact with an outflowing lower body of water 88 along interface 90. Such segregated flow activity of fuel and water is concentrated along the top and bottom walls 24 and 42 of the tank 10 in contrast with a buoyant flow event as depicted in FIG. 11 in connection with top and bottom bodies of fuel 86 and water 88 within existing fuel/water tanks. In connection with tank 10, in addition to the manhole openings 82 and 83 the top and bottom flow holes 78 and 80 in the transverse walls 56 and 58 allow the body of fuel 86 to flow along the top of the tank for backfilling thereof to adequately maintain the interface 90 between the bodies of fuel 86 and water 88 as shown in FIG. 10, preventing buoyant flow activity. Holes 80 in the transverse walls 56 and 58 accommodates flow of the body of water 88 with a reduction in the amount of water trapped along the bottom wall 42 behind the internal tank walls so as to minimize water retention. Further, since the strongest flows of fuel and water are respectively established through the openings 78 and 80 along the top wall 24 and bottom wall 42 of tank 10 with reduced flow through the manholes 82 and 83 along the interface 90, fuel and water mixing is reduced to thereby reduce the amount of fuel in the water outflow through flow port 48.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a multi-function tank having top, bottom and outer side walls enclosing compartments formed by an internal wall structure to provide for both storage of fuel and ballast of water by inflow of the fuel and outflow of the water during refueling, resulting from flow of the fuel and water through the compartments within the tank, said inflow of the fuel and said outflow of the water being conducted through the internal wall structure, the improvement residing in: flow directing means formed in the internal wall structure for concentrating said inflow and outflow respectively along segregated flow paths in contact with each other within the compartments while minimizing mixing of the fuel and the water and reducing retention of the water in the tank.

2. The combination as defined in claim 1 wherein said internal wall structure includes an intermediate wall extending between two of the outer side walls in spaced relation to the other of the outer side walls of the tank, said flow directing means including: spaced openings formed in the intermediate wall through which said inflow of the fuel and the outflow of the water is respectively established in said flow paths along the top and bottom walls while reduced flow of the fuel and water is conducted along an interface between said flow paths at which said contact is established.

3. In combination with a multi-function tank having top, bottom and outer side walls enclosing compartments formed by an internal wall structure to provide for both storage of fuel and ballast of water by inflow of the fuel and outflow of the water during refueling, resulting from flow of the fuel and water through the compartments within the tank, the improvement residing in: flow regulating means in said internal wall structure for concentration of said inflow of the fuel and said outflow of the water respectively along segregated flow paths through the compartments within the tank to minimize mixing of the fuel and the water and reduce retention of the water in the tank, said internal wall structure including an intermediate wall extending between two of the outer side walls in spaced relation to the other of the outer side walls of the tank, said flow regulating means including: spaced openings formed in the intermediate wall through which said concentration of the inflow of the fuel and the outflow of the water is conducted along an interface between said flow paths, and flow ports respectively established in spaced adjacency to the top and bottom walls of the tank through which said inflow of the fuel is received and said outflow of the water is discharged respectively, said spaced openings in the intermediate wall in spaced adjacency to the top wall dimensionally increasing in a direction toward the flow port established adjacent to the top wall.

4. In combination with a tank having external walls provided with flow ports through which inflow of fuel and outflow of water is respectively received and discharged during a refueling operation, and an internal wall structure through which flow of the fuel and the water between said flow ports is conducted within the tank along interfaced flow paths in contact with each other, the improvement residing in: flow regulating means formed in said internal wall structure from which said flow of the fuel and the water is directed along said interfaced flow paths for minimizing mixing of the fuel and the water during said refueling operation.

5. The improvement as defined in claim 4, wherein said flow regulating means includes openings formed in the internal wall structure to minimize retention of the water in the tank.

* * * * *